US012139910B2

(12) United States Patent
Nordlund

(10) Patent No.: US 12,139,910 B2
(45) Date of Patent: Nov. 12, 2024

(54) METHOD OF FORMING A SURFACE OF AN INTERIOR WALL OR A CEILING

(71) Applicant: Smartax Byggmaterial AB, Järfälla (SE)

(72) Inventor: Lennart Nordlund, Stockholm (SE)

(73) Assignee: Smartax Byggmaterial AB, Järfälla (SE)

( * ) Notice: Subject to any disclaimer, the term of this patent is extended or adjusted under 35 U.S.C. 154(b) by 115 days.

(21) Appl. No.: 17/769,248

(22) PCT Filed: Oct. 15, 2020

(86) PCT No.: PCT/SE2020/050983
§ 371 (c)(1),
(2) Date: Apr. 14, 2022

(87) PCT Pub. No.: WO2021/076035
PCT Pub. Date: Apr. 22, 2021

(65) Prior Publication Data

US 2023/0287681 A1 Sep. 14, 2023

(30) Foreign Application Priority Data

Oct. 18, 2019 (SE) ..... 1951182-3

(51) Int. Cl.
*E04C 2/28* (2006.01)
*E04C 2/00* (2006.01)

(52) U.S. Cl.
CPC ..... *E04C 2/28* (2013.01); *E04C 2002/004* (2013.01)

(58) Field of Classification Search
CPC ... E04C 2/28; E04C 2/043; E04C 2/40; E04C 2002/004; E04F 13/0889; E04F 13/0894;
(Continued)

(56) References Cited

U.S. PATENT DOCUMENTS 2,142,305 A 1/1939 Davis
2,427,879 A 9/1947 Robertson et al.
(Continued)

FOREIGN PATENT DOCUMENTS

CA 2967459 A1 11/2018
CH 428155 A 1/1967
(Continued)

OTHER PUBLICATIONS

International Search Report and Written Opinion for International Application No. PCT/SE2020/050983, mailed Apr. 15, 2021, (20 pages).
(Continued)

*Primary Examiner* — Mark R Wendell
(74) *Attorney, Agent, or Firm* — Kagan Binder, PLLC

(57) ABSTRACT

This document a method for forming a surface of an interior wall or a ceiling. The method comprises providing a pair of building boards (S1, S2), attaching by means of nails (3) the first building board (S1) to a stud (2), joining the edge portion (1') of the second building board (S2) with the edge portion (1) of the first building board, so that the tongue (101) of the first building board extends into the groove (102) of the second building board, attaching by means of nails (3) the second building board (S2) to the stud (2), and gluing a surface covering fabric (4) directly to an exposed main surface (11, 12) of the building boards (S1, S2), such that the surface covering fabric covers the building boards (S1, S2). The document discloses a method for manufacturing a prefabricated building element, a structure comprising a pair of building boards, and a way of manufacturing a building board.

18 Claims, 4 Drawing Sheets

(58) Field of Classification Search
CPC .. E04F 13/002; E04F 13/0835; E04F 13/0878
USPC ..... 52/588.1
See application file for complete search history.

(56) References Cited

U.S. PATENT DOCUMENTS

| | | | | |
|---|---|---|---|---|
| 3,984,269 | A | 10/1976 | Schneller et al. | |
| 6,367,524 | B1 | 4/2002 | Brewer | |
| 7,051,486 | B2 * | 5/2006 | Pervan | E04F 15/04 52/584.1 |
| 7,171,791 | B2 * | 2/2007 | Pervan | E04F 15/04 52/592.1 |
| 2004/0173783 | A1 | 9/2004 | Curzon et al. | |
| 2004/0206038 | A1 * | 10/2004 | Stanchfield | A47G 27/045 52/582.1 |
| 2006/0070333 | A1 * | 4/2006 | Pervan | B27F 1/02 52/592.1 |
| 2023/0287681 | A1 * | 9/2023 | Nordlund | E04C 2/043 |

FOREIGN PATENT DOCUMENTS

| | | | |
|---|---|---|---|
| DE | 19708868 | A1 | 9/1998 |
| EP | 1455028 | A1 | 9/2004 |
| EP | 3208401 | A1 | 8/2017 |
| FR | 607777 | A | 7/1926 |
| GB | 541733 | A | 12/1941 |
| WO | 2012152994 | A1 | 11/2012 |
| WO | 2014167184 | A1 | 10/2014 |
| WO | 2019060523 | A1 | 3/2019 |

OTHER PUBLICATIONS

Swedish Search Report for Swedish Application No. 1951182-3, mailed on Apr. 14, 2020, (2 pages).
E-Spacenet English Machine Translation for CH 428155 A.
E-Spacenet English Abstract and Machine Translation for DE 19708868 A1.
E-Spacenet English Machine Translation for FR 607777 A.

* cited by examiner

METHOD OF FORMING A SURFACE OF AN INTERIOR WALL OR A CEILING

CROSS-REFERENCE TO RELATED APPLICATIONS

This application claims priority to International Application No. PCT/SE2020/050983, filed Oct. 15, 2020 and titled "METHOD OF FORMING A SURFACE OF AN INTERIOR WALL OR A CEILING," which in turn claims priority from a Swedish Patent Application having serial number 1951182-3, filed Oct. 18, 2019, both of which are incorporated herein by reference in their entireties.

TECHNICAL FIELD

The present document relates to a method for providing a surface coating for interior walls or ceilings.

The document also relates to such a surface coating and a method for manufacturing a building board for forming of such surface coating.

BACKGROUND

WO2012152994 A1 discloses a building board which is suitable for interior walls and ceilings. The building board has a joint edge with a profile that causes adjacent building boards to engage with each other and prevent relative movement between the building boards as seen in a direction perpendicular to the main plan of the building boards.

An advantage of those in WO2012152994A1 is that they, thanks to the profiled joint edge, requires relatively little puttying to achieve an acceptable smoothness of the formed interior wall or ceiling.

Puttying is still a time-consuming moment during construction and renovation, since the drying times are long. The problem is normally handled by circulating the personnel who perform puttying, sanding, painting, etc. between different spaces on a construction site or even between different construction sites, so that the puttied surfaces have time to dry.

The puttying is an even bigger problem in prefab-manufacturing, i.e. in manufacturing of wall elements, building elements or building modules (each of which includes floors, ceilings and walls), where surfaces of walls and ceilings shall be finished, or at least provided with a paintable surface already at delivery from the factory.

In prefab-manufacturing, you are forced to solve the puttying by providing buffer stocks, where the puttied wall- or building elements get to dry. This is space consuming.

Thus, there is a need for an improved way of forming a surface of interior wall or ceiling.

SUMMARY

It is an object to provide an improved way of providing a surface for an interior wall or a ceiling. A particular object is to solve the problem of long drying times for puttying of joints in interior walls and ceilings.

The invention is defined by the appended independent claims. Embodiments are set forth in the dependent claims, of the following description and of the appended drawings.

According to a first aspect, there is provided a method of forming a surface of an interior wall or a ceiling. The method comprises providing a pair of building boards, comprising a first building board and a second building board, wherein each of the building boards have a pair of parallel and opposite main surfaces, wherein a central plane is defined as a plane which is parallel to the main surfaces and which is equidistant from the first main surface as from the second main surface, wherein a joint plane is defined as a plane which is perpendicular to the main surfaces and which comprises an outer edge of at least one of the main surfaces, wherein edge portions of the building boards have a locking system, for locking the building boards relative to each other in direction perpendicular to the main surfaces, wherein each edge portion has a constant profile along the edge portion, comprising a tongue and a groove, wherein the tongue is entirely on one side of the central plane, wherein the groove is entirely on a second side of the central plane, wherein the groove has a height, as seen in direction perpendicular to the main planes, which is at least equal a height of the tongue, wherein the groove has a depth from the joint plane, as seen in direction perpendicular to the joint plane, wherein the tongue has a protrusion from the joint plane, as seen in the direction perpendicular to the joint plane, wherein the depth of the groove is at least as large as the protrusion of the tongue, and attaching the first building board to a stud by means of nails, joining the edge portion of the second building board with the edge portion of the first building board, such that the tongue of the first building board extends into the groove of the second building board, and such that the tongue of the second building board extends into the groove of the first building board, attaching the second building board to the stud by means of nails, and gluing a surface covering fabric directly to an exposed main surface of the building boards, such that the surface covering fabric covers the building boards.

By "surface covering fabric" is meant a fabric that is formed to completely cover a wall, either to form a finished surface, or to form a paintable surface. The fabric can be thin, preferably 0.1-2 mm thick and flexible.

Thus, the surface covering fabric can be a wallpaper or a wall covering web. A wall covering web can be primed or pre-painted.

The surface covering fabric may be a nonwoven fabric, such as fiber web or a nonwoven web. Fiber can be glass fibers, wood-based fiber, such as paper fibers, or polymer fibers.

Specifically, the term "surface covering fabric" does not cover such products as tape, joint strips, puttying strips or other products intended to be placed only over an area around a joint between building boards, and which thereby are not intended to cover the entire wall.

By gluing the surface covering fabric "directly to an exposed" surface of the building boards is meant that no intermediate puttying or other leveling strip is arranged between the main surfaces of the building boards and the surface covering. Thus, the surface covering abuts against, and is fixed to, the entire exposed main surface.

Consequently, according to the method, there is no puttying of the joint that occurs between the building boards. Thus, a very time-consuming step during construction can be avoided, which leads to large savings in construction time.

The method may further comprise sanding at least one of the main surfaces of the building boards within an area that extends along the joint plane, but less than 50% of the extent of the building boards as seen in said direction perpendicular to the joint plane, preferably less than 40%, less than 30% or less than 20%.

The first main surface may have a finer surface finish than the second main surface.

Surface finish can be measured in Ra, according to known standards. By finer surface finish is meant that the first main surface has a lower Ra-value.

The building boards may be homogeneous.

By the building boards being "homogeneous" is meant that they consist of the same material right through. Thus, the core material in the building boards are exposed at their main surfaces. Specifically, the building boards lack surface coating layers, such as cardboard-, woven web- or web surface layers, covering the core of the building board.

The building boards may be formed of a fiber-reinforced material, such as gypsum fiber.

The surface covering fabric may comprise a web, a woven web, a nonwoven fabric or a wallpaper.

The method may comprise applying glue between the stud and one of the main surfaces which is facing the stud, and/or applying glue on a joint surface formed by the tongue and the groove.

In the method, the profile may have a first edge portion, extending between the tongue and the first main surface, and a second edge portion, extending between the groove and the second main surface, wherein the edge portions of the profiles have substantially equal extent, as seen in the direction perpendicular to the main surfaces.

In the method, the first building board may have a second edge portion, which is perpendicular to the first edge portion of the first building board and is formed the same as the first edge portion of the first building board, wherein the second building board has a second edge portion, which is perpendicular to the first edge portion of the second building board and is formed the same as the first edge portion of the second building board. The first and second building boards are joined so that said second edge portions are aligned with each other. Said second edge portions have a constant profile along the second edge portion, which comprises at least one tongue and/or at least one groove. The method comprises providing a third building board, which has a first edge portion having a constant profile along the first edge portion, which comprises at least one tongue and/or at least one groove, and the method comprises joining the first edge portion of the third building board with the second edge portions of both the first and the second building board, such that the joint plane formed by the first and second building boards cuts the first edge portion of the third building board at a distance from edge portions of the third building board that are parallel to the joint plane.

An intersection point between the joint plane and the first edge portion of the third building board, as seen in a plane parallel to the main surfaces, are at a distance from said stud.

According to a second aspect, there is provided a method of manufacturing a prefabricated building element, wherein the method comprises: forming a surface according to what has been described above, so that the surface forms a part of the building element, moving the building element from a manufacturing site to a mounting site, and attaching the building element at the mounting site.

The building element may be a wall or a part of a wall. Alternatively, the building element can be a joist system or a part of a joist system. As a further alternative, the building element can be a building module, comprising at least two walls, a floor joist system and a ceiling joist system.

The movement may comprise at least one lifting step, wherein the building element is lifted by means of a crane, forklift or the like.

Further, the movement may comprise at least one transport step, such as with truck or train.

Specifically, said surface can be formed in a serial production plant.

A serial production plant can be a factory for the manufacture of prefabricated walls, prefabricated joist systems or prefabricated house modules.

According to a third aspect, there is provided a structure in form of an interior wall or a ceiling, comprising a first building board and a second building board, wherein each of the building boards have a pair of parallel and opposite main surfaces, wherein a joint plane is defined as a plane which is perpendicular to the main surfaces and which comprises an outer edge of at least one of the main surfaces, wherein edge portions of the building boards have a locking system, for locking the building boards relative to each other in direction perpendicular to the main surfaces. Each edge portion has a constant profile along the edge portion, wherein at least one of the edge portions comprises a tongue and at least one of the edge portions comprises a groove. The building boards are attached by means of nails to at least one stud, wherein the edge portion of the second building board is joined with the edge portion of the first building board, such that the tongue of the first building board extends into the groove of the second building board, and wherein a surface covering fabric is directly glued against an exposed main surface of the building boards, such that the surface covering fabric covers the building boards.

In the structure, a central plane is defined as a plane which is parallel to the main surfaces and which is equidistant from the first main surface as from the second main surface. Each edge portion has a constant profile along the edge portion, comprising a tongue and a groove, wherein the tongue is entirely on one side of the central plane and the groove is entirely on a second side of the central plane. The groove has a height, as seen in direction perpendicular to the main planes, which is at least equal a height of the tongue. The groove has a depth from the joint plane, as seen in direction perpendicular to the joint plane, and the tongue has a protrusion from the joint plane, as seen in the direction perpendicular to the joint plane, wherein the depth of the groove is at least as large as the protrusion of the tongue. The tongue of the second building board extends into the groove of the first building board.

The first main surface may have a finer surface finish than the second main surface.

Surface finish can be measured in Ra, according to known standards. By finer surface finish is meant that the first main surface has a lower Ra-value.

The building boards are homogeneous.

By the building boards being "homogeneous" is meant that they consist of the same material right through. Thus, the core material in the building boards are exposed at their main surfaces. Specifically, the building boards lack surface coating layers, such as cardboard-, woven web- or web surface layers, covering the core of the building board.

The building boards may be formed of a material comprising matrix material and fiber.

The matrix material may be gypsum, cement or polymer-based binder. The fiber may be organic or inorganic fiber, such as wood fiber. For example, the building boards can be formed of so-called "gypsum fiber" or MDF. Specifically, the building boards can consist of said material comprising matrix material and fiber.

The surface covering fabric may comprise a web, a woven web, a nonwoven fabric or a wallpaper.

Glue may be present between the stud and one of the main surfaces facing the stud, and/or on a joint surface formed by the tongue and the groove.

The profile may have a first edge portion extending between the tongue and the first main surface, and a second edge portion extending between the groove and the second main surface, wherein the edge portions of the profiles have substantially equal extent, as seen in the direction perpendicular to the main surfaces.

According to a fourth aspect, there is provided a building element comprising a structure according to what has been described above, wherein the building element is movable for mounting at another place than where the building element has been joined.

According to a fifth aspect, there is provided a method for manufacturing a building board for formation of an interior wall or a ceiling. The method comprises: providing a board blank, having a pair of parallel and opposite main surfaces, providing a cutting tool, for forming of an edge profile of the board blank by cutting machining, placing the board blank in a cutting device, determining a reference position for the board blank along a geometric axis extending perpendicular to the main surfaces, setting a tool position for the cutting tool along the geometric axis, wherein the tool position is set based on the reference position, bringing the cutting tool into engagement with the board blank, and providing a relative offset between the board blank and the cutting tool along an edge of the board blank. The reference position for the board blank is selected as that of the main surfaces having a finer surface finish than the other main surface.

DETAILED DESCRIPTION

Figure 1A:
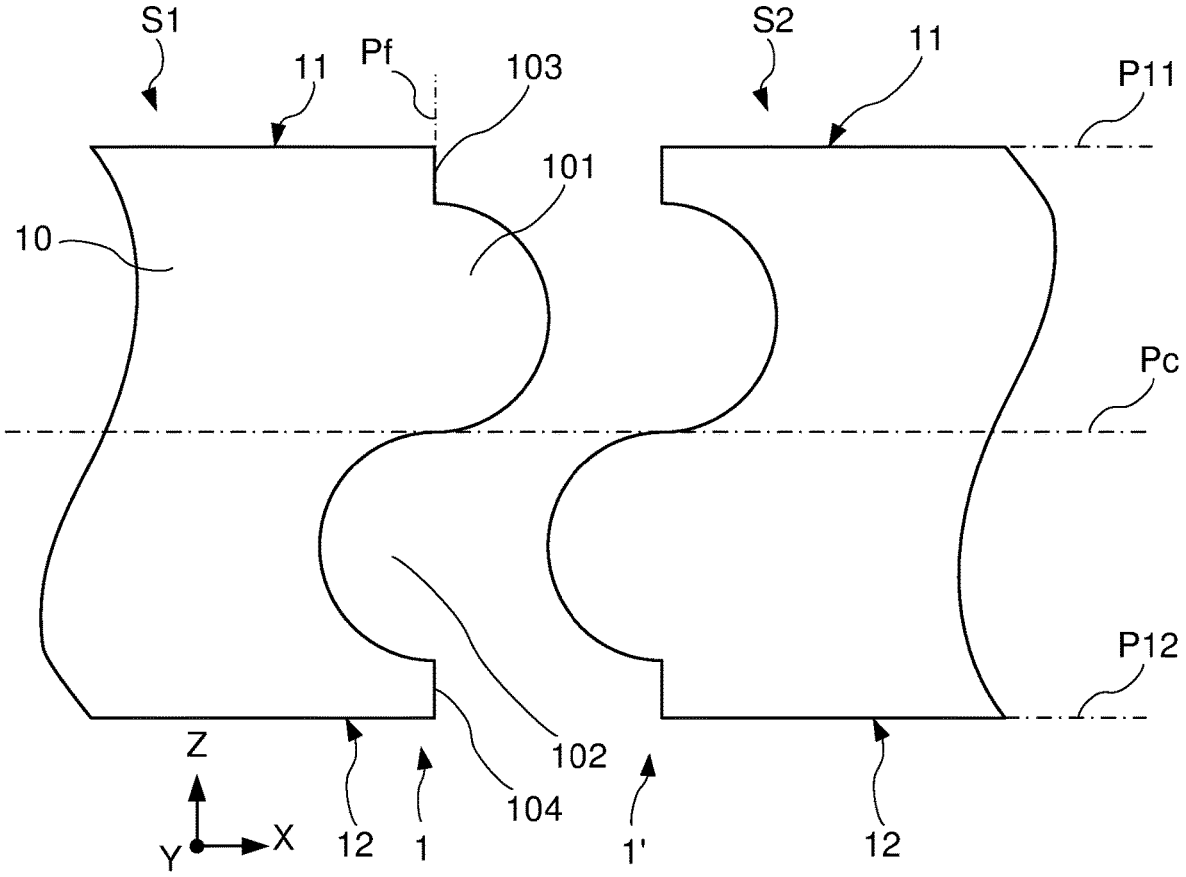
FIG. 1*a*-1*b* show a pair of edge portions 1, 1' of building boards.

FIG. 1*a* shows a pair of edge portions 1, 1' of a pair of building boards S1, S2. Each building board S1, S2 has a body 10, a first main surface 11 and a second main surface 12, on the opposite side of the body 10. As shown in FIG. 1*a*, the main surfaces 11, 12 are parallel to an X-Y plane.

The building boards S1, S2 have a respective edge portion 1, 1' which have one edge profile with a tongue 101, a groove 102, a first edge outer portion 103 and a second edge outer portion 104.

A central plane Pc is defined as a plane that is parallel to the main surfaces 11, 12 and which is substantially equidistant from the first main surface 11 as from the second main surface 12, "substantially" indicates that tolerances and surface unevenness of the main surfaces may give rise to some deviation.

A joint plane Pf is defined as a plane perpendicular to the main surfaces 11, 12 and that comprises an outer edge of at least one of the main surfaces, so that two adjacent interconnected building boards S1, S2 meet at the joint plane. The joint plane Pf can coincide with the edge outer portions 103, 104. As is evident from FIG. 1*a*, the joint plane is parallel to a Y-Z plane.

The tongue 101 is entirely on one side of the central plane Pc and the groove is entirely on the other side of the central plane Pc.

As seen in projection on the joint plane Pf, an outermost point of the tongue 101 and an innermost point of the groove 102 may present the same distance to the central plane Pc.

The extents of the tongue and groove in the normal direction of the main surfaces 11, 12 can be equal.

The protrusion of the tongue 101 outside the joint plane can be as large as, or less than, the greatest depth of the groove 102 from the joint plane.

In the embodiment shown, both the tongue 101 and the groove 102 are formed with semicircular cross-sections, so that the tongue and the groove both are tangent to the center plane Pc in the same point.

Figure 1B:
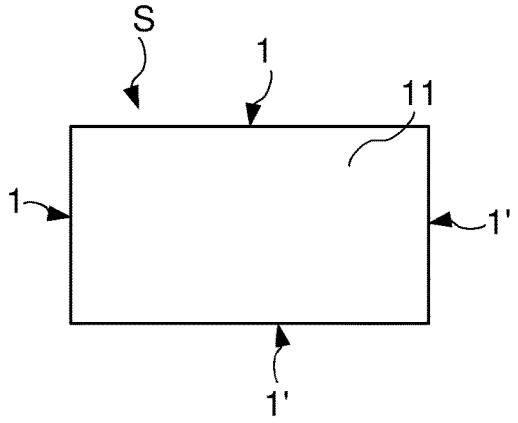

FIG. 1*b* schematically shows a building board as seen in plan view perpendicular to one of the main surfaces 11, where the embodiment of the edge portions 1, 1' is shown. As is evident, the building board S is rectangular (oblong or square) and has one first pair of adjacent and between themselves perpendicularly themselves extending edge portions 1, the tongue and groove of which are oriented according to the left edge portion of FIG. 1*a* with the tongue 101 closest to the exposed main surface 11. Further, the building board S has a pair of adjacent and between themselves perpendicularly themselves extending edge portions 1', the tongue and groove of which are oriented according to the right edge portion 1' in FIG. 1*a* with the groove 102 closest to the exposed main surface 11.

With the tongue 101 and groove 102 being arranged mirror-inverted symmetrically around the central plane Pc, it is possible to use the building board regardless of which main surface 11, 12 is exposed. In addition, it is to a greater extent possible to use waste pieces sawn off of the building boards S, S1, S2 since they can be turned so that any of the main surfaces 11, 12 is exposed.

Figure 2:
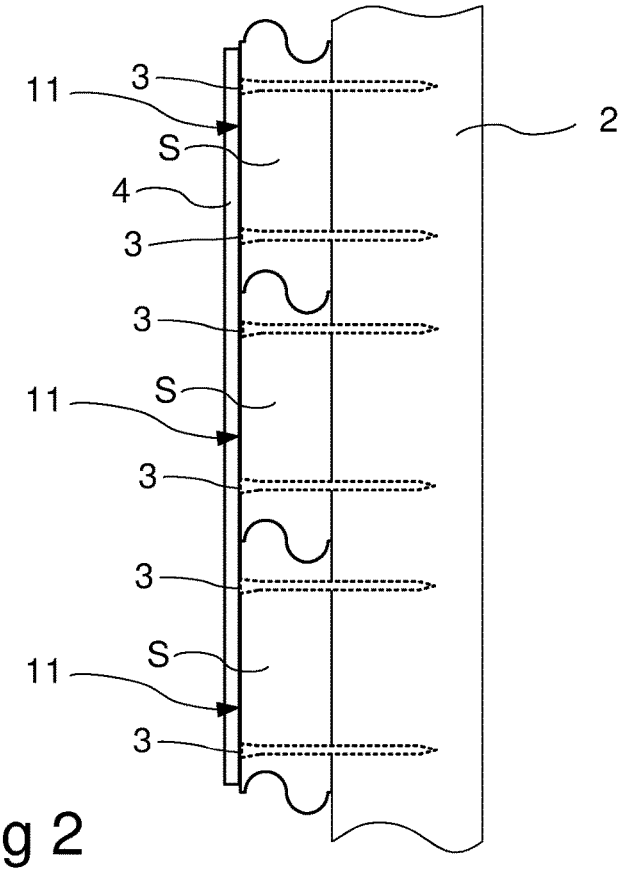
FIG. 2 shows a wall construction.

FIG. 2 shows a schematic sectional view of a structure comprising a stud 2, which may be a horizontal or vertical wall stud, a ceiling stud, a floor stud or a joist system. The stud can be formed of wood, metal (usually steel, steel sheet) or composite material, such as MDF.

In the example shown, the structure comprises three building boards S, which are attached to the joist system with nails or the like, preferably with a small head, such as "Dyckert", where the largest diameter of a nail head, as seen across the longitudinal direction of the nail, is less than 3 times the largest radius of the nail shank, preferably less than 2.5 times or less than 2 times the largest diameter of the nail shank. The nail is arranged so that the nail head is in plane with, or recessed in the surface 11, 12 of the building board.

When using a wooden stud, nails are usually fired or hit through the building board and into stud in a direction perpendicular to the wall surface.

When using a metal stud, nails are usually fired or hit through the building board and into stud in a direction that is not perpendicular to the wall surface, and usually 1-40 degrees downward. Usually the angle is 10-30 degrees downwards relative to a horizontal plane.

When mounting on a stud, glue can also be applied between stud and building board, in addition to nails. The building boards S are attached with said nails placed along the joint edges 1, 1', where these overlap a stud 2.

With the joint with tongue 101 and groove 102, it is also provided an improved stability at a distance from the stud, since each building board engages with adjacent building board.

As shown in FIG. 2, a glued surface covering fabric 4, such as a wallpaper, a fiber web, such as fiberglass fabric, a reinforcing fabric, a nonwoven web, such as fiber felt, or similar has been applied directly to the building board, without puttying.

Thus, the surface covering fabric 4 is glued directly to the main surface 11 on both sides of each joint plane.

The surface covering fabric 4 is usually mounted in the form of a plurality of lengths which are arranged next to each other, either edge to edge or with a very small overlap. Each length of surface covering fabric usually has a length corresponding to the height of a wall from floor to ceiling, or a ceiling length from wall to wall, taking into account tolerances and if any baseboards and/or cornices. Each length of surface covering fabric can have a width, which may be in the range of 40-120 cm, preferably about 60-90 cm.

Figure 3:
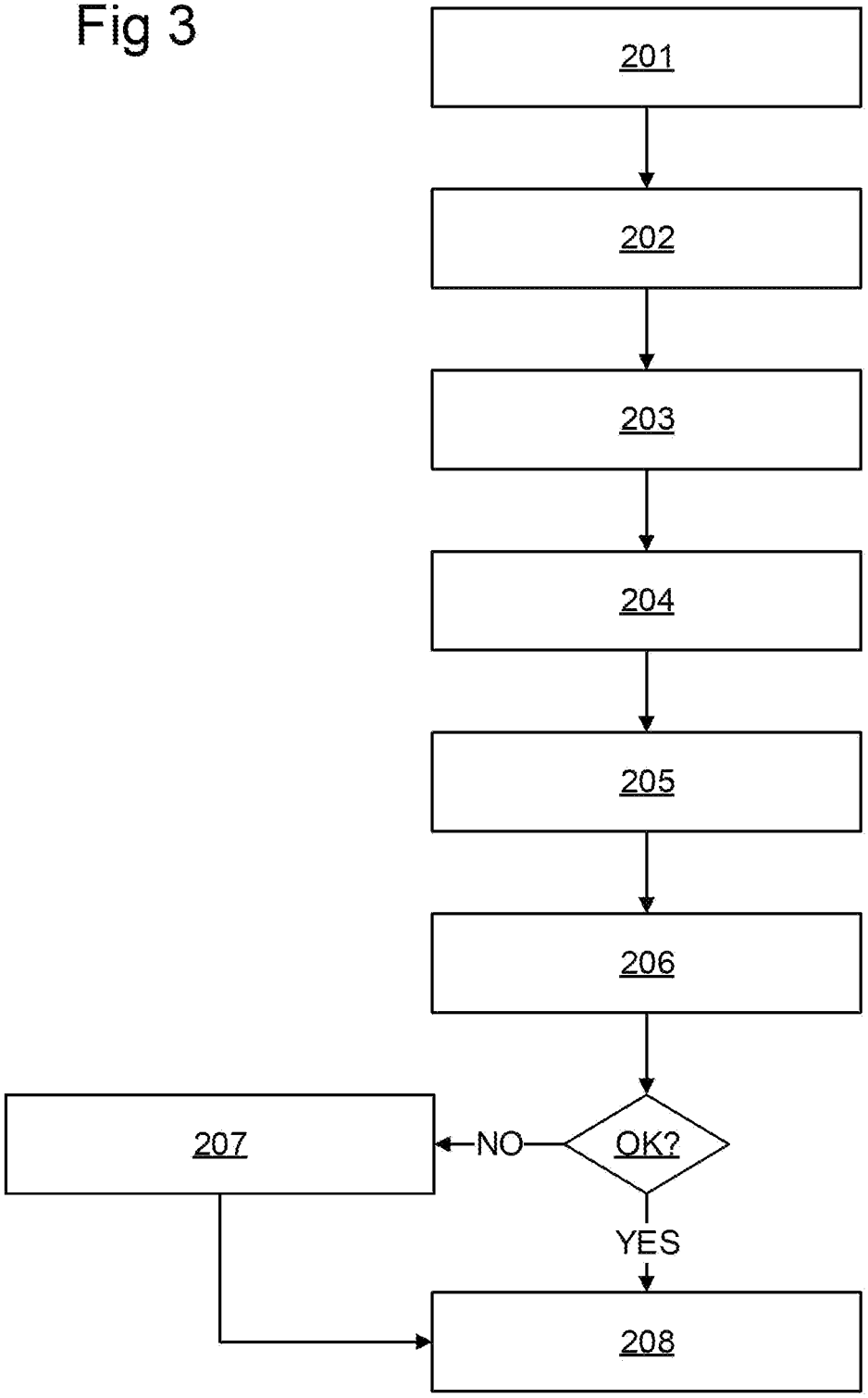
FIG. 3 shows a method for forming a wall surface.

FIG. 3 shows a method for forming a wall surface.

The method comprises providing 201 at least a pair of studs, which are arranged to form a stud wall, a ceiling or an interior floor.

Further, the method comprises providing 202 at least a pair of building boards as described above.

Optionally, one or both of the building boards can be sawn to fit against the studs.

A first one of the building boards is nailed 203 to at least one of the studs 2.

A second one of the building boards is joined 204 with the first one of the building boards by interconnecting the joint edge 1' of the second building board with the joint edge 1 of the first building board, as shown in FIG. 1*a*.

Before joining, glue can, but does not have to, be applied to the joint, to give the finished wall increased stability, for example to allow mounting of fitments on the wall.

Then the second building board is nailed 205 to at least one of the studs 2.

A check 206 can then be made to assess whether a joint formed between the building boards is sufficiently smooth. Such control can be done by dragging across the joint with the hand.

If the joint is smooth enough, the surface covering fabric can be glued 208 directly on the boards and over the joint.

If the joint is too prominent, the edge portions 1, 1' at the exposed main surface 11 can be sanded 207, for example sandpapered, the joint to the desired smoothness, after which the surface covering fabric is glued 208.

The method can be used when assembling walls or ceilings at site in a building that is under construction, renovation or modification.

Alternatively, the method can be used in the manufacture of prefabricated building elements, such as walls, joist systems or building modules, which is then lifted with a crane or forklift, and possibly transported to construction site by truck and/or train for assembly to a building.

Figure 4:
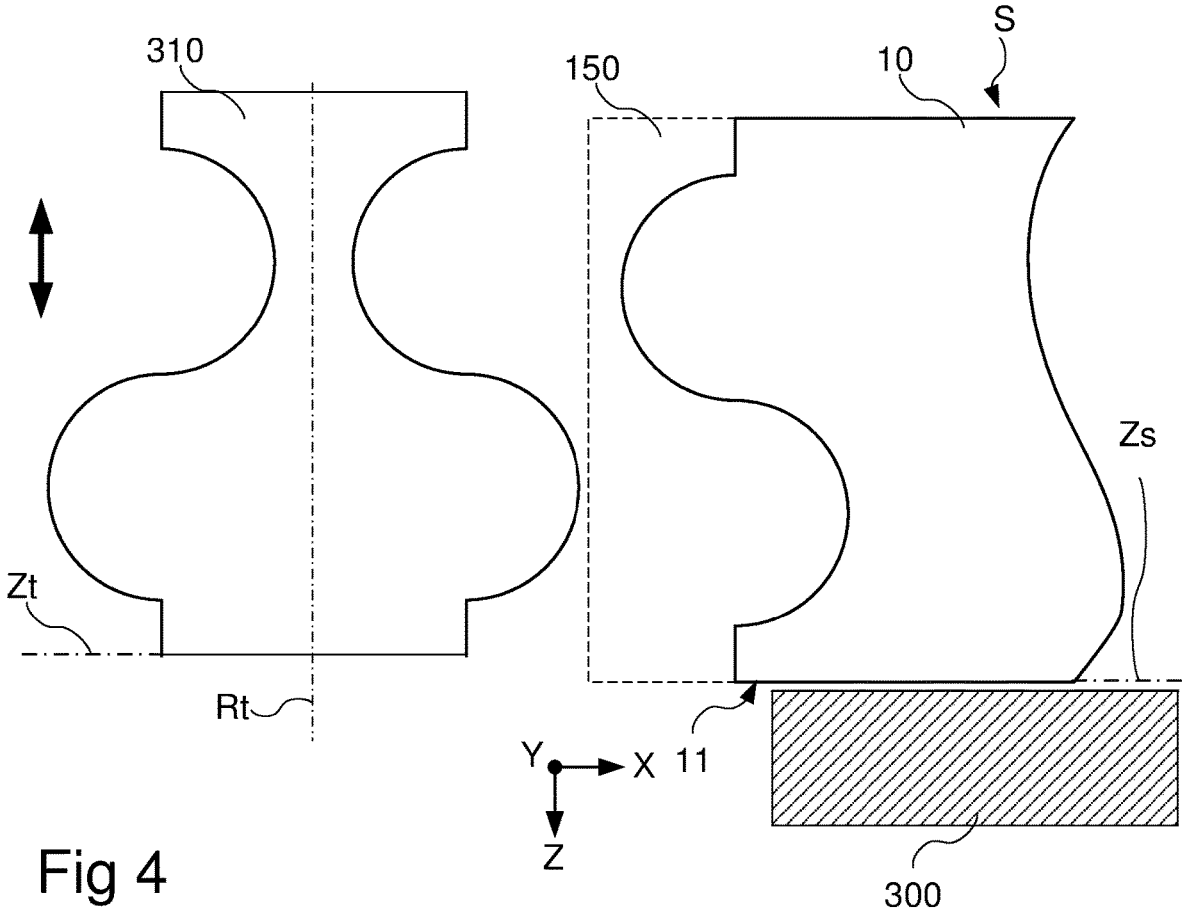
FIG. 4 shows an edge portion of a board blank and a tool for machining of the edge portion.

Referring to FIG. 4, it is explained how the edge portion 1, 1' can be machined for formation of the joint edge.

A board blank is placed on a substrate 300, which forms a reference point Zs along an axis Z which is perpendicular to the main surfaces 11, 12.

A tool in the form of a cutter 310, which has an axis of rotation Rt and a profile corresponding to the edge profile to be provided, is brought into engagement with the edge portion of the board blank and is moved along a direction Y, which is parallel with the longitudinal direction of the edge portion 1, 1', so that a portion 150 of the edge portion of the board blank is cut off and the desired profile is formed.

The milling tool 310 can have the shape of a pin mill, i.e. have a small radius in relation to the cutting surface of the tool. Alternatively, the tool can be designed as a circular saw blade with a significantly larger radius in relation to the cutting surface of the tool.

Further, the profile can be formed by one, two or more tools that are brought in contact with the board blank in pairs simultaneously, or in sequence.

A reference point in the Z-direction can be determined also for the tool 310. This reference point is used together with the reference point Zs of the board blank to control the tool 310 in the Z-direction so that the axial center of the tool coincides with the central plane Pc, so that the joint becomes symmetrical about the central plane Pc.

By placing the board blank with the main surface 11, 12 having the best smoothness against the substrate, improved precision at the determination of the reference point Zs for the board blank is achieved, wherein the position of the tool in the Z-direction can be optimized to achieve a smooth joint.

The building boards S, S1, S2 are preferably of homogeneous material, i.e. the whole building board is formed in a single material, such as gypsum fiber, particle board, MDF or the like, wherein the board has no surface layer in another material than the core of the board, as is the case with plasterboards (which may have surface layers of paper) or mineral boards (which may have surface layers of fiberglass fabric).

Figure 5:
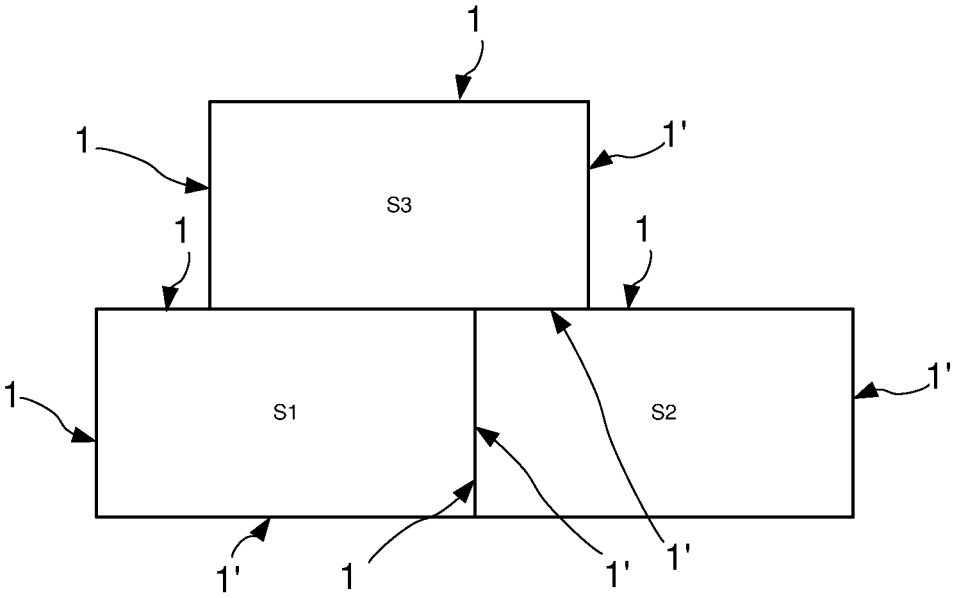
FIG. 5 shows an arrangement of joined building panels.

Referring to FIG. 5, three such building boards S1, S2, S3 are shown as shown in FIG. 2.

In the example shown, the building boards S1, S2, S3 are rectangular, and have a pair of opposite edge portions according to FIG. 1 on the short sides and a pair of opposite edge portions according to FIG. 1 on the long sides.

The building boards S1 and S2 are joined together along a pair of short sides, as described above.

The third building board S3 is joined along a long side with both the first building board S1 and the second building board S2, such that short sides of the third building board are offset relative to short sides of the first and second building boards.

It is understood that corresponding arrangements with offset short sides may be achieved with square building boards, or by instead joining the first and second building boards S1, S2 long side against long side and then joining the third building board S3 along a short side with both the first building board S1 and the second building board S2, so that long sides of the third building board are offset in relation to long sides of the first and second building boards S1, S2.

Offsetting rows of building boards S1, S2, S3 as shown in FIG. 5 is possible thanks to the joining which is achieved with the help of the profiled edge portions 1, 1'. In such offsetting, it may be particularly suitable to also apply glue in the joints.

It is understood that when joining building panels in such a way as shown in FIG. 5, edge panels will need to be cut in a conventional manner. By using pairs of opposite edge portions which are identical to each other on the long side and short side, increased flexibility is achieved when using waste pieces formed by cutting.

The invention claimed is:

1. A method for forming a surface of an interior wall or a ceiling, comprising:

providing a pair of building boards, comprising a first building board and a second building board, wherein each of the building boards have a pair of parallel and opposite main surfaces, wherein a central plane is defined as a plane which is parallel to the main surfaces and which is equidistant from the first main surface as from the second main surface, wherein a joint plane is defined as a plane which is perpendicular to the main surfaces and which comprises an outer edge of at least one of the main surfaces, wherein edge portions of the building boards have a locking system, for locking the building boards relative to each other in direction perpendicular to the main surfaces, wherein each edge portion has a constant profile along the edge portion, comprising a tongue and a groove, wherein the tongue is entirely on one side of the central plane, wherein the groove is entirely on a second side of the central plane, wherein the groove has a height, as seen in direction perpendicular to the main planes, which is at least equal a height of the tongue, wherein the groove has a depth from the joint plane, as seen in direction perpendicular to the joint plane, wherein the tongue has a protrusion from the joint plane, as seen in the direction perpendicular to the joint plane, wherein the depth of the groove is at least as large as the protrusion of the tongue, and attaching the first building board to a stud by means of nails, joining the edge portion of the second building board with the edge portion of the first building board, such that the tongue of the first building board extends into the groove of the second building board, and such that the tongue of the second building board extends into the groove of the first building board, attaching the second building board to the stud by means of nails, sanding at least one of the main surfaces of the building boards within an area that extends along the joint plane, but less than 50% of the extent of the building boards as seen in said direction perpendicular to the joint, and gluing a surface covering fabric directly to an exposed main surface of the building boards, such that the surface covering fabric covers the building boards.

2. The method according to claim 1, wherein the first main surface has a finer surface finish than the second main surface.

3. The method according to claim 1, wherein the building boards are homogeneous.

4. The method according to claim 1, wherein the building boards are formed of a fiber-reinforced material.

5. The method according to claim 1, wherein the surface covering fabric comprises a web, a woven web, a nonwoven fabric or a wallpaper.

6. The method according to claim 1, wherein the profile has a first edge portion, extending between the tongue and the first main surface, wherein the profile has a second edge portion, extending between the groove and the second main surface, and wherein the edge portions of the profiles have substantially equal extent, as seen in the direction perpendicular to the main surfaces.

7. The method according to claim 1, further comprising:

applying glue between the stud and one of the main surfaces which is facing the stud, and/or applying glue to a joint surface formed by the tongue and the groove.

8. The method according to claim 1, wherein the first building board has a second edge portion, which is perpendicular to the first edge portion of the first building board and is formed the same as the first edge portion of the first building board, wherein the second building board has a second edge portion, which is perpendicular to the first edge portion of the second building board and is formed the same as the first edge portion of the second building board, wherein the first and second building boards are joined so that said second edge portions are aligned with each other, wherein said second edge portions have a constant profile along the second edge portion, which comprises at least one tongue and/or at least one groove, wherein the method comprises providing a third building board, which has a first edge portion having a constant profile along the first edge portion, which comprises at least one tongue and/or at least one groove, and wherein the method comprises joining the first edge portion of the third building board with the second edge portions of both the first and the second building board, such that the joint plane formed by the first and second building boards cuts the first edge portion of the third building board at a distance from edge portions of the third building board that are parallel to the joint plane.

9. The method according to claim 8, wherein an intersection point between the joint plane and the first edge portion of the third building board, as seen in a plane parallel to the main surfaces, are at a distance from said stud.

10. A method of manufacturing a prefabricated building element, wherein the method comprises:

forming a surface according to claim 1, so that the surface forms a part of the building element, moving the building element from a manufacturing site to a mounting site, and attaching the building element at the mounting site.

11. The method according to claim 10, wherein said surface is formed in a serial production plant.

12. A structure in form of an interior wall or a ceiling, comprising:

a pair of building boards, comprising a first building board and a second building board, wherein each of the building boards have a pair of parallel and opposite main surfaces, wherein a central plane is defined as a plane which is parallel to the main surfaces and which is equidistant from the first main surface as from the second main surface, wherein a joint plane is defined as a plane which is perpendicular to the main surfaces and which comprises an outer edge of at least one of the main surfaces, wherein edge portions of the building boards have a locking system, for locking the building boards relative to each other in direction perpendicular to the main surfaces, wherein each edge portion has a constant profile along the edge portion, comprising a tongue and a groove, wherein the tongue is entirely on one side of the central plane, wherein the groove is entirely on a second side of the central plane, wherein the groove has a height, as seen in direction perpendicular to the main planes, which is at least equal a height of the tongue, wherein the groove has a depth from the joint plane, as seen in direction perpendicular to the joint plane, wherein the tongue has a protrusion from the joint plane, as seen in the direction perpendicular to the joint plane, wherein the depth of the groove is at least as large as the protrusion of the tongue, wherein the building boards are attached by means of nails to at least one stud, wherein the edge portion of the second building board is joined with the edge portion of the first building board, such that the tongue of the first building board extends into the groove of the second building board and such that the tongue of the second building board extends into the groove of the first building board, and wherein at least one of the main surfaces of the building boards has been sanded within an area that extends along the joint plane, but less than 50% of the extent of the building boards as seen in said direction perpendicular to the joint, and wherein a surface covering fabric is directly glued against an exposed main surface of the building boards, such that the surface covering fabric covers the building boards.

13. The structure according to claim 12, wherein the first main surface has a finer surface finish than the second main surface.

14. The structure according to claim 12, wherein the building boards are formed of a material comprising matrix material and fiber.

15. The structure according to claim 12, wherein the surface covering fabric comprises a web, a woven web, a nonwoven fabric or a wallpaper.

16. The structure according to claim 12, wherein glue is present between the stud and one of the main surfaces facing the stud, and/or on a joint surface formed by the tongue and the groove.

17. The structure according to claim 12, wherein the profile has a first edge portion extending between the tongue and the first main surface, wherein the profile has a second edge portion extending between the groove and the second main surface, and wherein the edge portions of the profiles have substantially equal extent, as seen in the direction perpendicular to the main surfaces.

18. A building element comprising a structure according to claim 12, wherein the building element is movable for mounting at another place than where the building element has been joined.

* * * * *